United States Patent [19]

Kleinert et al.

[11] 4,019,823

[45] Apr. 26, 1977

[54] RING BINDER

[75] Inventors: Heinz Kleinert, Lubbecke; Karl-Heinz Schudy, Espelkamp, both of Germany

[73] Assignee: Robert Krause KG, Hindenburgring, Germany

[22] Filed: Feb. 27, 1976

[21] Appl. No.: 661,923

Related U.S. Application Data

[63] Continuation of Ser. No. 529,206, Dec. 3, 1974, abandoned.

[30] Foreign Application Priority Data

Dec. 6, 1973 Germany ..... 2360721

[52] U.S. Cl. ..... 402/75; 281/29; 402/80 R

[51] Int. Cl.[2] ..... B42F 13/00

[58] Field of Search ..... 402/74, 75, 76, 77, 402/80 R, 80 L, 24, 26, 29, 31, 36, 37; 281/36, 37, 29

[56] References Cited

UNITED STATES PATENTS

| | | | |
|---|---|---|---|
| 90,052 | 5/1869 | Saurman | 281/37 |
| 1,290,907 | 1/1919 | Cardy | 402/75 X |
| 1,724,407 | 8/1929 | Lotter | 402/31 |
| 2,251,614 | 8/1941 | Martin | 402/76 X |

*Primary Examiner*—Jerome Schnall
*Attorney, Agent, or Firm*—Frank J. Jordan

[57] ABSTRACT

A ring binder has a ring mechanism on the inside of the binder spine and two boards covering the inside surfaces of the binder covers which are hinged to the spine, the boards forming extensions which extend the covers inwardly close to the rings when the binder is open to provide flat writing supports, and the binder has straps interconnecting the covers and supporting the extensions which extend the covers inwardly.

2 Claims, 3 Drawing Figures

RING BINDER

Figure 1:
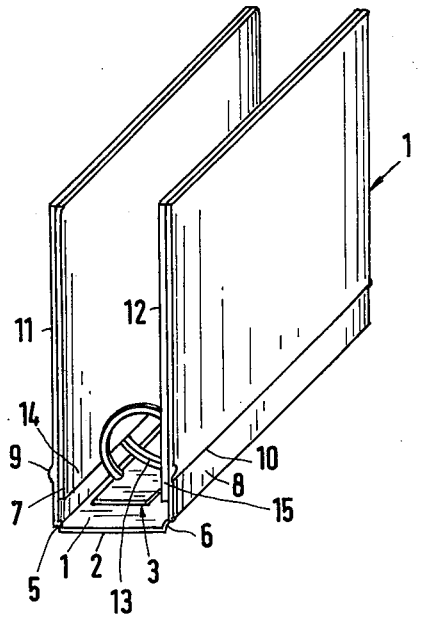

This is a continuation, of application Ser. No. 529,206 filed Dec. 3, 1974, now abandoned.

The present invention relates to a ring book, commonly referred to as a "ring binder." A ring binder comprises a binding cover having a spine which is divided from the front and rear cover parts by folds defining hinge axes, and a ring mechanism is fastened to the spine to hold punched stationery, i.e. paper.

When ring binders of this type are opened, only those sheets of paper which are disposed on the right-hand side of the ring mechanism can be written on without hindrance. The upwardly-projecting rings of the ring mechanism considerably obstruct the writer's hand, if he is right-handed, should he try to write on papers disposed to the left of the ring mechanism. It is therefore awkward to write on both sides of a sheet of paper while held by the ring mechanism. Accordingly, to facilitate writing on the rear pages of the sheets of paper, the sheets in practice are removed from the ring binder and are subsequently replaced. This is time-consuming, temporarily upsets the arrangement of collation of the sheets in the binder and presents the risk of the sheets being reinserted in an incorrect order.

The principal object underlying the invention is to provide a ring binder in which the customary hindrance to writing on both sides of the paper held in the binder is minimised to the fullest possible extent so as to make it unnecessary to remove the sheets of paper from the ring binder before writing on both sides of the sheets.

According to the present invention, there is provided a ring book comprising a spine, two covers hingedly connected thereto and a ring binding mechanism for holding punched stationery secured to the spine, there being an intermediate cover part between each cover and the spine with first and second folds defining hinge axes respectively between the spine and each of the intermediate parts and between the intermediate parts and the adjoining covers, the intermediate parts being connected by connecting webs secured to the covers adjacent the second folds and the connecting webs determining the positions of the intermediate parts with respect to the spine when the book is opened, the position between the said parts being variable and alignable at an angle to the spine.

Preferably, one or each of the covers is fitted on its inside surface with a supporting web which projects freely over the associated intermediate part in the direction of the ring mechanism and which overlaps the said second fold of the intermediate part, which fold is, of course, disposed on the outside of the supporting web, the said web presenting a writing support forming an extension of the inside cover surface.

In a ring book forming a preferred embodiment of the invention, the ring mechanism is given a sunken disposition between the inner surfaces of the cover parts with the result that the rings of the ring mechanism do not project to any notable extent above sheets of paper inserted in the ring book. It is thus possible to write on both the front and rear surfaces of the sheets without hindrance by the rings of the ring mechanism. One can write without difficulty almost as far as the perforations or punch holes in the sheets. The ring book has a further advantage that it will adapt to the height of a stack of paper disposed on the left-hand and/or on the right-hand side of the ring mechanism, since the open-folded position of the respective intermediate parts can, in a reciprocal dependence on their angular alignment, be adjusted to the respective conditions via the connecting webs.

Figure 2:
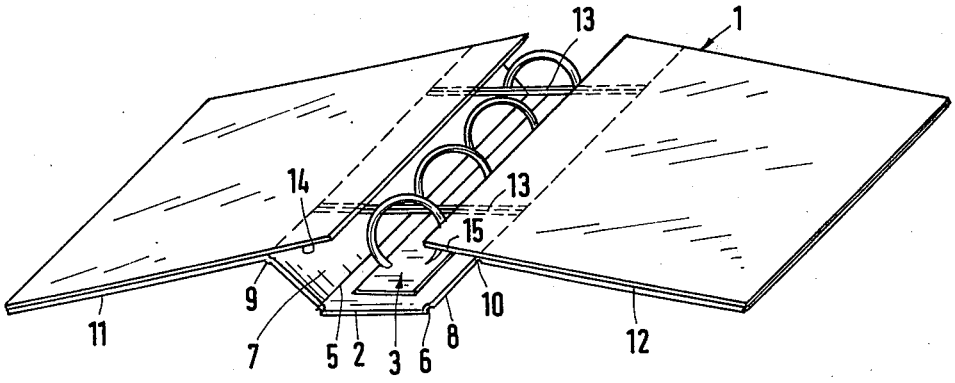
Figure 3:
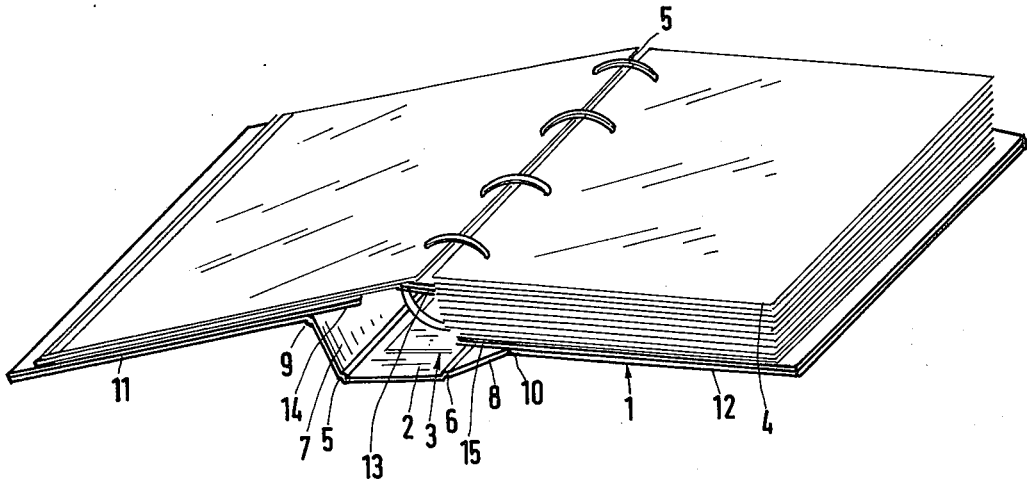

A preferred embodiment of the invention will now be described in greater detail by way of example with reference to the accompanying drawings in which:

FIG. 1 shows a perspective view of a ring binder according to the invention, in a closed condition, FIG. 2 shows a perspective view of the binder in an opened condition without any sheets of paper therein, and FIG. 3 shows a view similar to that of FIG. 2, but showing the binder filled with sheets of paper ready to be written upon.

The ring book illustrated in the drawings consists of a binding cover 1 and a spine 2 on the inside of which there is fastened a ring binding mechanism 3 for accepting sheets of paper 4. The spine 2 is laterally bounded by folds 5, 6, each of which define a hinge axis. The folds 5, 6 separate the spine 2 from intermediate parts 7, 8 and the latter are hingedly connected on the outside to cover boards 11, 12 of the binding cover 1 via folds 9, 10 respectively. In addition to being connected to the spine 2, the two intermediate parts 7, 8 are furthermore connected to one another by connecting webs 13. The webs 13 are fastened to the binding cover 1 in the region of the folds 9, 10 and when the ring book is opened, as shown in FIG. 2, the webs 13 determine the opened positions of the intermediate parts, which can be varied between them and which is angularly aligned, in relation to the spine 2. The connecting webs 13, which are flexible but unchangeable in length consist, for example, of bands.

To the inner surfaces of the cover boards 11, 12 are respectively fastened paper supporting plies 14, 15, which freely project toward the ring mechanism 3 over the associated intermediate parts 7, 8. The paper supports 14, 15 overlap the folds 9 or 10 which are disposed outwardly thereof, and when the ring binder is open, the supports 14, 15 define a supporting plane extension of the inner surface of the cover boards 11, 12. The width of the intermediate parts 7, 8 is dimensioned in relation to the width of the spine 2, and to the distance by which the ring mechanism projects vertically to the plane of the spine 2, and the length of the connecting webs 13 is so chosen that the result is the rings of the ring mechanism are almost completely below the inner surfaces of the cover boards and the paper supports 14, 15 extending them. In a preferred embodiment, in which the height of the ring mechanism 3 is only slightly less than the width of the spine 2, e.g. 4 mm less, the width of the intermediate parts 7, 8 is two thirds of the width of the spine 2. The length of the connecting webs 13 was selected in such a way that in the symmetrical angular alignment of the intermediate parts 7, 8 relative to the spine 2, as shown in FIG. 2, the spine forms angle of approximately 135° with each of the intermediate parts. Accordingly, when the ring book is opened, an imagined extension of the plane of at least one of the paper supports 14 or 15 is tangential to the rings of the ring mechanism 3 and while the imagined extension of the plane of the other paper support may intersect the rings of the ring mechanism in a chord-like manner such as shown in the left and ring hand half respectively, of FIG. 3. Thus, the rings of the ring mechanism project above the plane of the upwardly-directed surfaces of sheets of paper 4 only to such a slight extent that they do not obstruct writing on the sheets which are disposed either on the left-hand or the right-hand side of the ring mechanism. The paper supports provide support for sheets of paper when these are being written on, which support extends comparatively closely to the rings of the ring mechanism 3.

In the example shown, the binding cover 1 is made in one piece which has been shaped to book form by appropriate folding. The cover boards 11, 12 each consist of an outer and an inner ply, the inner plies forming the paper supports 14, 15. Both plies are glued to one another from their outer borders to the folds 9, 10. This not only ensures that the writing supporting surface for the sheets of paper is smooth but also allows a particularly simple fastening of the connecting webs 13 by gluing them between the two plies on either side of the spine 2.

We claim:

1. A ring book comprising a spine, a ring binding mechanism having rings for holding punched stationery sheets secured to said spine, intermediate cover parts hinged to said spine at a first hinge axis, cover members hinged to said intermediate cover parts at a second hinge axis, said spine, said intermediate cover parts, and said cover members being formed in one piece and comprising outer plies integral with one another, a writing support member secured to each of said cover members and projecting from said respective cover member beyond said second hinge axis toward said ring binding mechanism, said writing support members comprising inner plies of said cover members presenting a support surface forming a coextensive extension of said cover members, flexible connecting webs of invariable length extending between said intermediate cover parts and secured to said intermediate cover parts adjacent said second hinge axes, said webs having a length greater than the width of said spine such that said intermediate cover parts are disposed at an obtuse angle relative to said spine when the ring book is open and said webs are taut, said writing support members having a width such that when the book is in said open position the inner terminating edges of said writing support members fall without an imaginary cylinder defined by said rings whereby said cover members and coextensive writing support members are freely movable independently of said rings, said spine and intermediate cover parts being pivotally connected at said first and second hinges such that angular displacement of one of said intermediate cover parts relative to said spine effects a corresponding but opposite angular displacement of said other intermediate cover part relative to said spine, said intermediate cover parts being pivotal relative to said spine to an operative position to dispose one of said writing support members in a position such that an imagined extension of the plane of said one writing support member intersects said rings chordally when the ring book is open and lying on a flat surface member and to dispose the other writing support member in a position such that an imagined extension of the plane of said other writing support member is approximately tangential to said rings when the ring book is open to thereby preclude interference by the rings as handwriting is manually effected on the edge portion of a punched stationery sheet disposed on said other writing support member.

2. A ring book according to claim 1, wherein said ring binding mechanism projects from said spine by a distance approximately equal to the width of said spine, and said intermediate cover parts each have a width approximately equal to two-thirds of the width of said spine.

* * * * *